US009141078B2

(12) United States Patent
Nakajima et al.

(10) Patent No.: US 9,141,078 B2
(45) Date of Patent: Sep. 22, 2015

(54) IMAGE RECORDING DEVICE

(71) Applicant: MURATA MACHINERY, LTD., Kyoto-shi, Kyoto (JP)

(72) Inventors: Takehiro Nakajima, Kyoto (JP); Yasuhiro Sakanashi, Kyoto (JP); Shu Ikezaki, Kyoto (JP)

(73) Assignee: MURATA MACHINERY, LTD., Kyoto (JP)

( * ) Notice: Subject to any disclaimer, the term of this patent is extended or adjusted under 35 U.S.C. 154(b) by 73 days.

(21) Appl. No.: 14/037,109

(22) Filed: Sep. 25, 2013

(65) Prior Publication Data

US 2014/0099145 A1 Apr. 10, 2014

(30) Foreign Application Priority Data

Oct. 10, 2012 (JP) ..... 2012-224887

(51) Int. Cl.
*G03G 21/18* (2006.01)
*G03G 21/16* (2006.01)

(52) U.S. Cl.
CPC ..... *G03G 21/1676* (2013.01); *G03G 21/1821* (2013.01); *G03G 21/186* (2013.01); *G03G 21/1825* (2013.01); *G03G 21/1864* (2013.01)

(58) Field of Classification Search
CPC ..... G03G 21/1821; G03G 21/1825; G03G 21/1864; G03G 21/186
USPC ..... 399/117
See application file for complete search history.

(56) References Cited

U.S. PATENT DOCUMENTS 7,221,888 B2 * 5/2007 Hymas et al. ..... 399/111
2012/0328329 A1 * 12/2012 Sato et al. ..... 399/117

FOREIGN PATENT DOCUMENTS

JP 2011-102908 5/2011

* cited by examiner

*Primary Examiner* — David Gray
*Assistant Examiner* — Michael Harrison
(74) *Attorney, Agent, or Firm* — DLA Piper LLP (US)

(57) ABSTRACT

An image recording device includes a pressing force adjusting mechanism that adjusts a pressing force of a developing roller that is provided by an elastic member, against a photoconductive drum. This provides for modification and adjustment of the pressing force of the developing roller that is pressed against the photoconductive drum by the biasing force from the elastic member. Consequently, even where the developing rollers have various radius dimensions or where elastic force of the elastic member changes, adequate pressing force depending on each case can be applied to the developing roller, thereby improving the recorded quality of the image recording device.

5 Claims, 9 Drawing Sheets

IMAGE RECORDING DEVICE

CROSS-REFERENCE TO RELATED APPLICATIONS

This application claims priority under 35 U.S.C. 119 to Japanese Patent Application No. 2012-224887 filed on Oct. 10, 2012, which application is hereby incorporated by reference in its entirety.

BACKGROUND OF THE INVENTION

1. Field of the Invention

The present invention relates to an image recording device arranged to conduct a recording process for an image forming apparatus such as a copier, a facsimile machine, a printer and a multifunction peripheral, particularly, to technology used to adjust a pressing force of a developing roller against a photoconductive drum.

2. Description of the Related Art

One of the substantive problems found in these image recording devices is deterioration in the image quality of a recorded image, which deterioration is caused by such change as making a pressing force of a developing roller large or small against a photoconductive drum. That is, aging and the like changes a biasing force of an elastic member arranged to press a developing roller against a photoconductive drum so that the previously-mentioned pressing force may be changed to deteriorate, the image quality of the recorded image. In addition, also in a case where developing rollers have variations in their diameters, the pressing force may change.

This problem becomes apparent in a case where a developing roller is replaceably configured. That is, this problem becomes apparent in a configuration where a toner agitating member and a developing roller are integrated as a developing unit so that the developing unit is replaced to replace the developing roller. This is because, in addition to such a factor as a change of biasing force of an elastic member variation in a structure for mounting a developing unit on a photoconductive unit, there is also a factor for changing the pressing force. In particular, a configuration in which developing unit is configured to be removably/rotatably mounted onto a coupling axis arranged between the photoconductive unit and the developing unit, worsened by complicated mounting structure, easily changes the pressing force when the developing unit is replaced.

Therefore, for example, an image forming apparatus disclosed in Japanese Unexamined Patent Application Publication No. 2011-102908 arranges a pressing unit arranged to press a developing unit against a photoconductive unit in a developing-device-housing unit arranged therein. That is, Japanese Unexamined Patent Application Publication No. 2011-102908 discloses a configuration arranged to press a developing unit against a photoconductive unit by using a pressing unit in an image forming apparatus which configures the developing unit to be removably and rotatably mounted on a coupling axis arranged between the photoconductive unit and the developing unit as described above. The pressing unit includes a cylindrical member, an elastic member arranged in the cylindrical member, and a movable member arranged to be moved in the cylindrical member by receiving a biasing force of the elastic member. By pressing the developing unit against the photoconductive unit by the biasing force of the elastic member, the developing roller can be arranged at a more precise position against the photoconductive drum.

However, the pressing unit according to Japanese Unexamined Patent Application Publication No. 2011-102908 cannot adjust the pressing force of the developing roller against the photoconductive drum at all. Consequently, in a case where the biasing force of the elastic member is changed or where the dimensions of the developing rollers are different, as mentioned above, the developing roller cannot be pressed against the photoconductive drum with an appropriate pressing force so that the image quality of the recorded image may deteriorate.

SUMMARY OF THE INVENTION

An object of the present invention is to improve the quality of a recorded image by ensuring uniform pressure of a developing roller against a photoconductive drum in an image recording apparatus that configures a developing unit to be removably and rotatably mounted on a photoconductive unit.

An image recording device according to one embodiment of the present invention includes a photoconductive unit which includes a photoconductive drum, a developing unit which includes a developing roller, and a coupling structure arranged between the photoconductive unit and the developing unit to removably and rotatably couple the developing unit with the photoconductive unit. An elastic member is arranged between the photoconductive unit and the developing unit to apply a pressing biasing force toward the photoconductive drum to the developing roller. The coupling structure includes a pressing force adjusting mechanism arranged to adjust a pressing force of the developing roller against the photoconductive drum, which force is provided by the elastic member.

The pressing force adjusting mechanism may include a coupling axis arranged on the developing unit, a bearing member formed in the photoconductive unit to hold the coupling axis in a freely-movable manner, and a positioning member arranged to position the coupling axis in the bearing member.

The positioning member may be a screw. In this case, a female screw portion into which the screw is screwed is formed in the bearing member.

The coupling axis may be rotatable in the bearing member while contacting with the axis end of an axis portion of the screw.

An elongated-hole-shaped bearing hole may be formed in the bearing member so that the coupling axis is configured to move freely in the bearing hole.

A cover member may be mounted onto an outer surface of the photoconductive unit so that the cover member and the coupling axis are coupled by a coupling member to regulate movement of the coupling axis in the axial direction in the bearing member.

A regulating structure arranged to regulate, in cooperation with a frame of an apparatus body of an image forming apparatus, movement of the photoconductive unit in the axial direction of the photoconductive drum in the apparatus body, may be formed on the photoconductive unit.

The cover member may be arranged to regulate movement of the developing roller in the axial direction, and the regulating structure may include a protruding portion formed on the cover member, and a concave portion formed on the frame of the apparatus body to receive the protruding portion.

An image recording device according to another embodiment of the present invention includes the photoconductive unit arranged to include the photoconductive drum, the developing unit arranged to include the developing roller, and a coupling structure arranged between the photoconductive unit and the developing unit to removably and rotatably couple the developing unit with the photoconductive unit. An elastic member is arranged between the photoconductive unit and the developing unit to apply a pressing biasing force toward the photoconductive drum to the developing roller. A parallelism adjusting mechanism arranged to adjust parallelism of the developing roller against the photoconductive drum is arranged in the coupling structure. The parallelism adjusting mechanism includes a coupling axis arranged on the developing unit, the bearing member arranged on the photoconductive unit to hold the coupling axis in a freely-movable manner, and a positioning member arranged to position the coupling axis in the bearing member. The elongated-hole-shaped bearing hole is formed in the bearing member so that the coupling axis is configured to be capable of moving freely in the bearing hole. The extending direction of the bearing hole and the extending direction of the positioning member are made identical with the straight line direction that connects the rotation shaft of the photoconductive drum and the rotation shaft of the developing roller.

In the image recording device according to the present invention, the coupling structure includes a pressing force adjusting mechanism arranged to adjust a pressing force of the developing roller against the photoconductive drum, which force is provided by the elastic member. This allows the pressing force adjusting mechanism to modify and change the pressing force of the developing roller, which is pressed against the photoconductive roller by biasing force from the elastic member. Even in a case where the developing rollers have variations in their radius diameters or where biasing force of the elastic member changes, appropriate pressing force can be applied to the developing roller in accordance with each case, thereby contributing to improve the recorded image quality provided by the image recording device.

The pressing force adjusting mechanism may include the coupling axis arranged on the developing unit, the bearing member arranged on the photoconductive unit to hold the coupling axis in a freely-movable manner, and the positioning member arranged to position the coupling axis in the bearing member. This allows the pressing force of the developing roller against the photoconductive drum to be modified and changed only by changing the position of the coupling axis in the bearing member by operating the positioning member. According to this configuration, the bearing member is only configured to hold the coupling axis in a freely-movable manner with adding the positioning member as a positioning member, thereby not only simplifying the structure but also suppressing increase of manufacturing costs for the image recording device added with the pressing force adjusting mechanism. In a case of replacing the developing unit, the pressing force can also be adjusted after coupling the developing unit with the photoconductive unit, thereby providing an easy adjusting operation.

The positioning member may be a screw and a female screw portion into which the screw is screwed may be formed in the bearing member. This allows the pressing force of the developing roller against the photoconductive drum to be arbitrarily modified for (in a continuously-variable manner) adjustment. As a result, an adequate adjusting operation of the pressing force can be easily conducted.

The coupling axis may be rotatable in the bearing member while contacting with the axis end of an axis portion of the screw. This can reduce the number of components and suppress increase of manufacturing costs for the image recording device, compared with a configuration that arranges other member between the axis end of the axis portion of the screw and the coupling axis.

An elongated-hole-shaped bearing hole may be formed in the bearing member so that the coupling axis is configured to move freely in the bearing hole. This can simplify the pressing force adjusting mechanism and suppress increase of manufacturing costs for the image recording device that includes the pressing force adjusting mechanism.

By coupling the cover member mounted on the outer surface of the photoconductive unit with the coupling axis by the coupling member, movement of the coupling axis in the axial direction in the bearing member may be regulated. This can prevent the coupling axis and the developing unit from accidentally being dislocated in the apparatus body, such as in a case where the photoconductive unit receives a shock caused by such operation as cover opening/closing. As a result, this can contribute to improve reliability of the image recording device and the image forming apparatus that includes this image recording device.

A regulating structure arranged to regulate, between the frame of the apparatus body and the photoconductive unit, movement of the photoconductive unit in the axial direction of the photoconductive drum in the apparatus body, may be provided. This can prevent the photoconductive unit from unintentionally being dislocated in the apparatus body, such as in a case where the photoconductive unit happens to receive a shock caused by such operation as cover opening/closing. As a result, this can contribute to improve reliability of the image recording device and an image forming apparatus that includes this image recording device.

The photoconductive unit may be provided with the cover member arranged to regulate movement of the developing roller in the axial direction, and the regulating structure may include a protruding portion formed on the cover member, and a concave portion formed on the frame of the apparatus body to receive the protruding portion. This can regulate movement of the photoconductive unit and the developing unit in the apparatus body by the regulating structure, while regulating movement of the developing roller in the axial direction by the cover member. This can prevent the photoconductive unit from unintentionally being dislocated in the apparatus body such as in a case where the photoconductive unit and the like happen to receive a shock caused by such operation as cover opening/closing, and contribute to improve reliability of the image recording device and the image forming apparatus that includes this image recording device. Defining the regulating structure by the protruding portion formed on the cover member and the concave portion formed on the frame of the apparatus body can not only simplify the regulating structure but also suppress increase of manufacturing costs for the image recording device that includes the regulating structure.

In the image recording device according to the present invention, the coupling structure may be configured to include a parallelism adjusting mechanism arranged to adjust parallelism of the developing roller against the photoconductive drum. This makes the developing roller take a position parallel to the photoconductive drum by positionally adjusting the developing roller against the photoconductive drum. Accordingly, even in a case where such factor as dimension error causes various radius dimensions in the developing rollers or where elastic force of the elastic member changes, the developing roller can be positionally modified to take an optimal position depending on each case. In addition, this can contribute to the qualitative improvement of recorded quality of the image recording device and an image forming apparatus provided with the device.

Other features, elements, processes, steps, characteristics and advantages of the present invention will become more apparent from the following detailed description of embodiments of the present invention with reference to the attached drawings.

DETAILED DESCRIPTION OF EMBODIMENTS OF THE INVENTION

In FIGS. 1 to 9, embodiments in which an image recording device according to the present invention is applied to a multifunction peripheral functioning as an image forming device provided with copy and facsimile functions, will be described. Front and back, right and left, and up and down directions in this description follow the arrows illustrated in FIGS. 1 to 3 and the like, and the indications of front and back, right and left, up and down described near the respective arrows.

Figure 2:
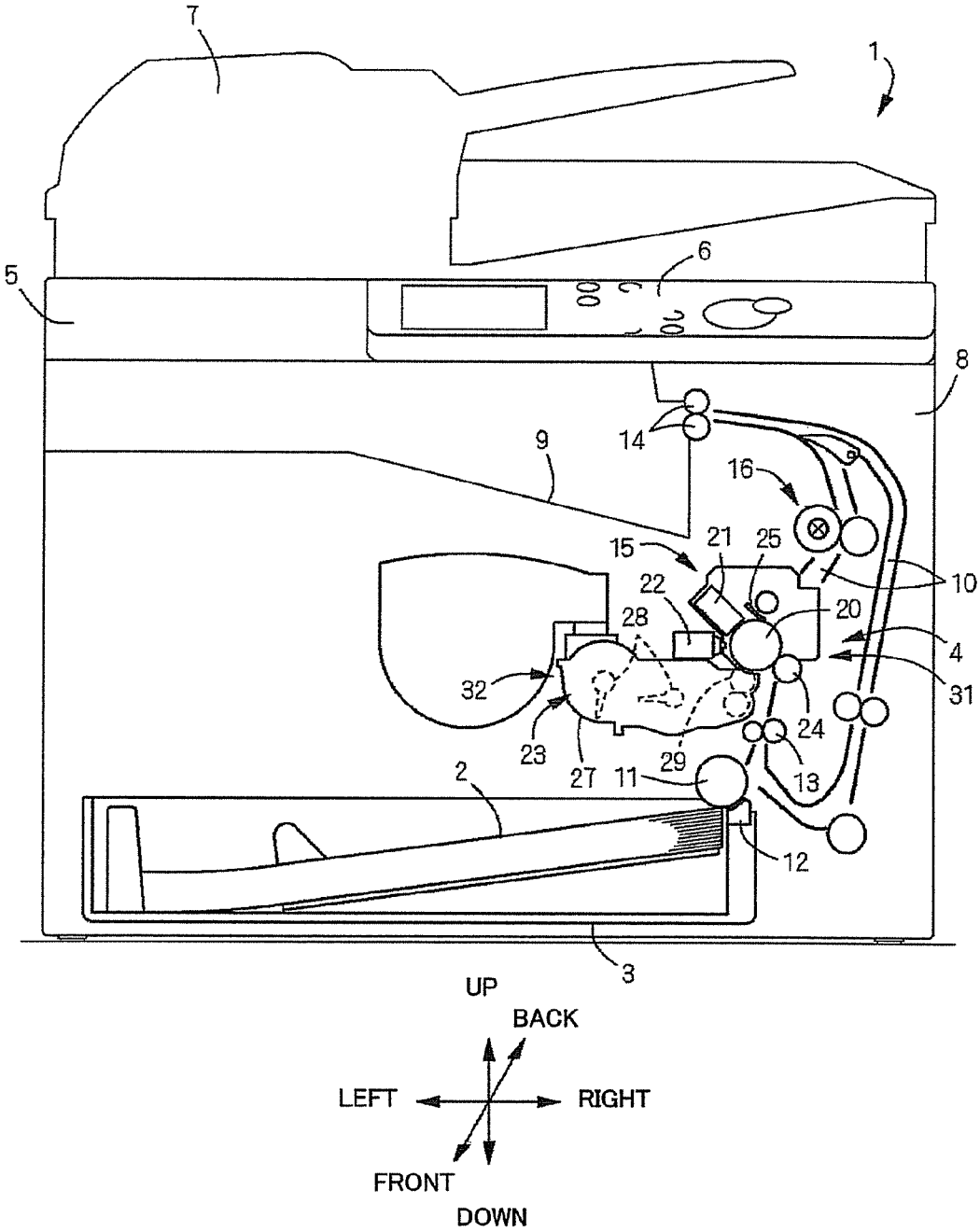
FIG. 2 is a schematic configuration diagram of an image forming apparatus to which the image recording device according to the present invention is applied.

In FIG. 2, a multifunction peripheral 1 includes a sheet feed cassette 3 arranged to place stacked recording sheets 2 thereon, an image recording unit (image recording device) 4 arranged to form toner image on a recording sheet 2 fed from the sheet feed cassette 3, and an image scanning portion 5 arranged above the image recording portion 4. On an upper surface of the image scanning portion 5, an operation panel 6 with various operation buttons, and an automatic document feeder (ADF) 7 are provided. The multifunction peripheral 1 forms therein a sheet transportation path 10 which leads from the sheet feed cassette 3 through the image recording portion 4 to a sheet exit portion 9 formed in the middle of an apparatus body 8.

The sheet feed cassette 3 includes a paper feed roller arranged to send out the recording sheet 2 to the sheet transportation path 10, and a friction pad 12 arranged to prevent multi feed of recording sheets while making pressure-contact with the sheet feed roller 11. Between the sheet feed roller 11 and the image recording portion 4 in the paper transportation path 10, a pair of resist rollers 13 arranged to control timing for feeding a sheet to the image recording portion 4 is provided to synchronize with toner image on the photoconductive drum 20 as described below. A sheet feed clutch is connected with the sheet feed roller 11 so that the sheet feed clutch is connected and disconnected to connect and disconnect driving force to the sheet feed roller 11, thereby controlling sheet feed interval. The sign 14 represents a pair of sheet discharge rollers arranged to discharge a recording sheet 2 to the sheet discharge portion 9.

The image recording portion 4 includes an image forming portion 15 arranged to form a toner image on a recording sheet 2 sent from the sheet feed cassette 3, and a fusing portion 16 arranged to fix the toner image by heating and pressing the recording sheet 2 on which the toner image is to be formed. The image forming portion 15 is configured to place the photoconductive drum 20 at the middle thereof. The photoconductive drum 20 is, when forming an image, rotated in the counterclockwise direction in FIG. 2. Around the photoconductive drum 20, a corona charger 21, a LED head 22, a developing device 23, a transfer roller 24 and a cleaning unit 25 are provided in order along the rotation direction. The LED head 22 forms an electrostatic latent image by exposing the surface of the photoconductive drum 20 charged by the charger 21.

The developing device 23 supplies toner to the surface of the photoconductive drum 20 via the developing roller 29. More specifically, the developing device 23 includes a housing 27 arranged to house toner, an agitator 28 arranged to agitate the toner in the housing 27, the developing roller 29 arranged on an opening portion of the housing 27, and a supplying roller 30 arranged to supply the toner to the developing roller 29.

The photoconductive drum 20, the charger 21 and the cleaning portion 25 are integrated into a unit component as a photoconductive unit 31. Similarly, the developing device 23 including the developing roller 29, the supplying roller 30, the housing 27 and the like are integrated into a unit component as a developing unit 32. The photoconductive unit 31 and the developing unit 32 are mounted in the apparatus body 8 as a configuration of a coupling unit 33 that couples the unit 31 and the unit 32 (cf. FIGS. 1, 3 and 5). Consequently, when replacing the developing roller 29, the developing unit 32 is dismounted from the photoconductive unit 31. More specifically, when replacing the developing roller 29, a cover of the apparatus body 8 is opened to draw out the coupling unit 33 that includes the photoconductive unit 31 and the developing unit 32, thereby removing the developing unit 32 from the photoconductive unit 31. Subsequently, a new developing unit 32 is mounted onto the photoconductive unit 32. Finally, the coupling unit 33 that includes photoconductive unit 31 and developing unit 32 is inserted into the apparatus body 8 followed by closing the cover. By such an operation as described above, a replacement operation of a developing roller is completed. When installing the coupling unit 33 into the apparatus body 8, the developing unit 32 is mounted onto the photoconductive unit 31, followed by an operation for adjusting the pressing force of the developing roller 29 against the photoconductive drum 20 and an operation for adjusting the position of the developing roller 28 using the adjusting mechanism 80 as described below.

Figure 1:
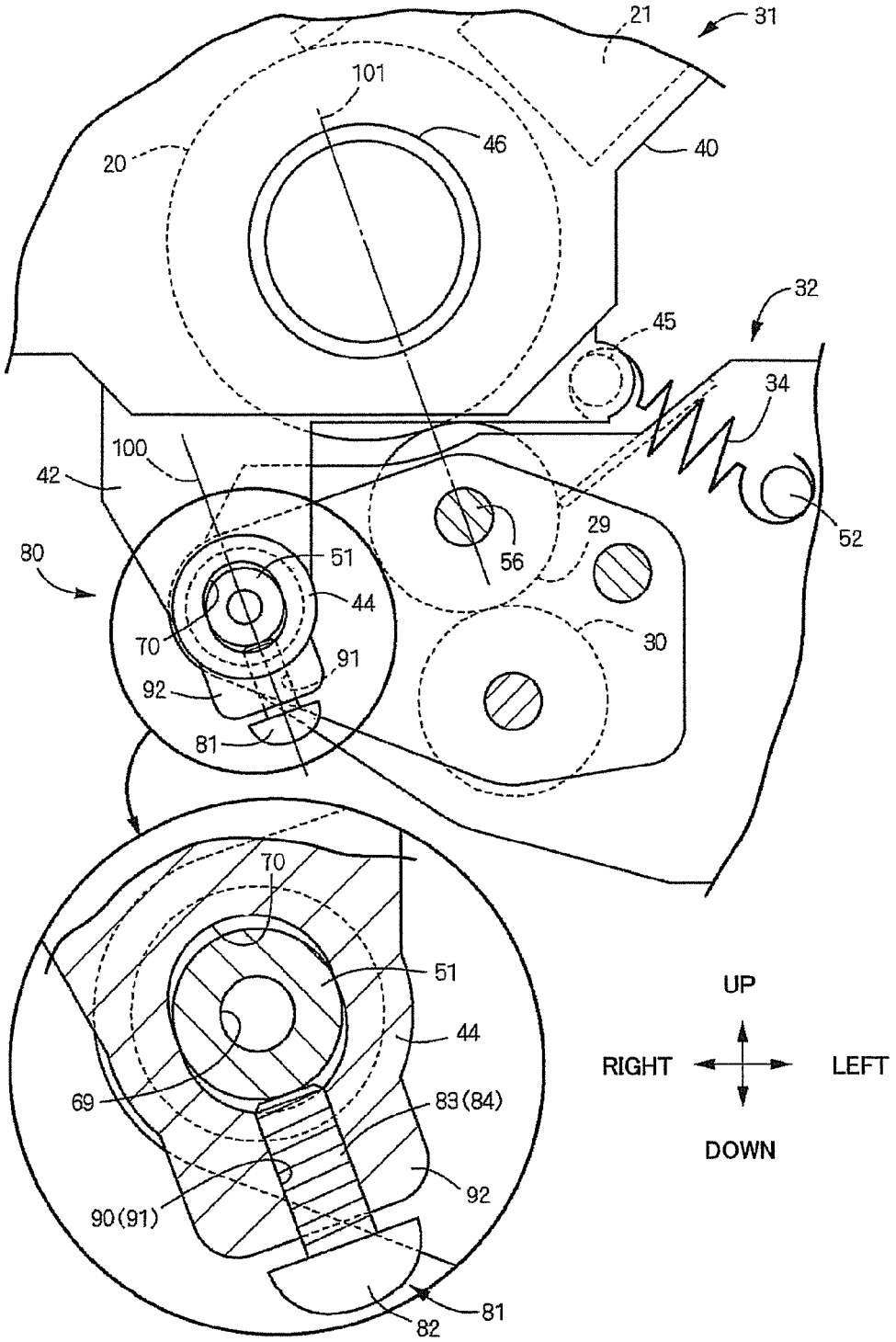
FIG. 1 is a schematic configuration diagram of a principal portion of an image recording device according to the present invention.
Figure 5:
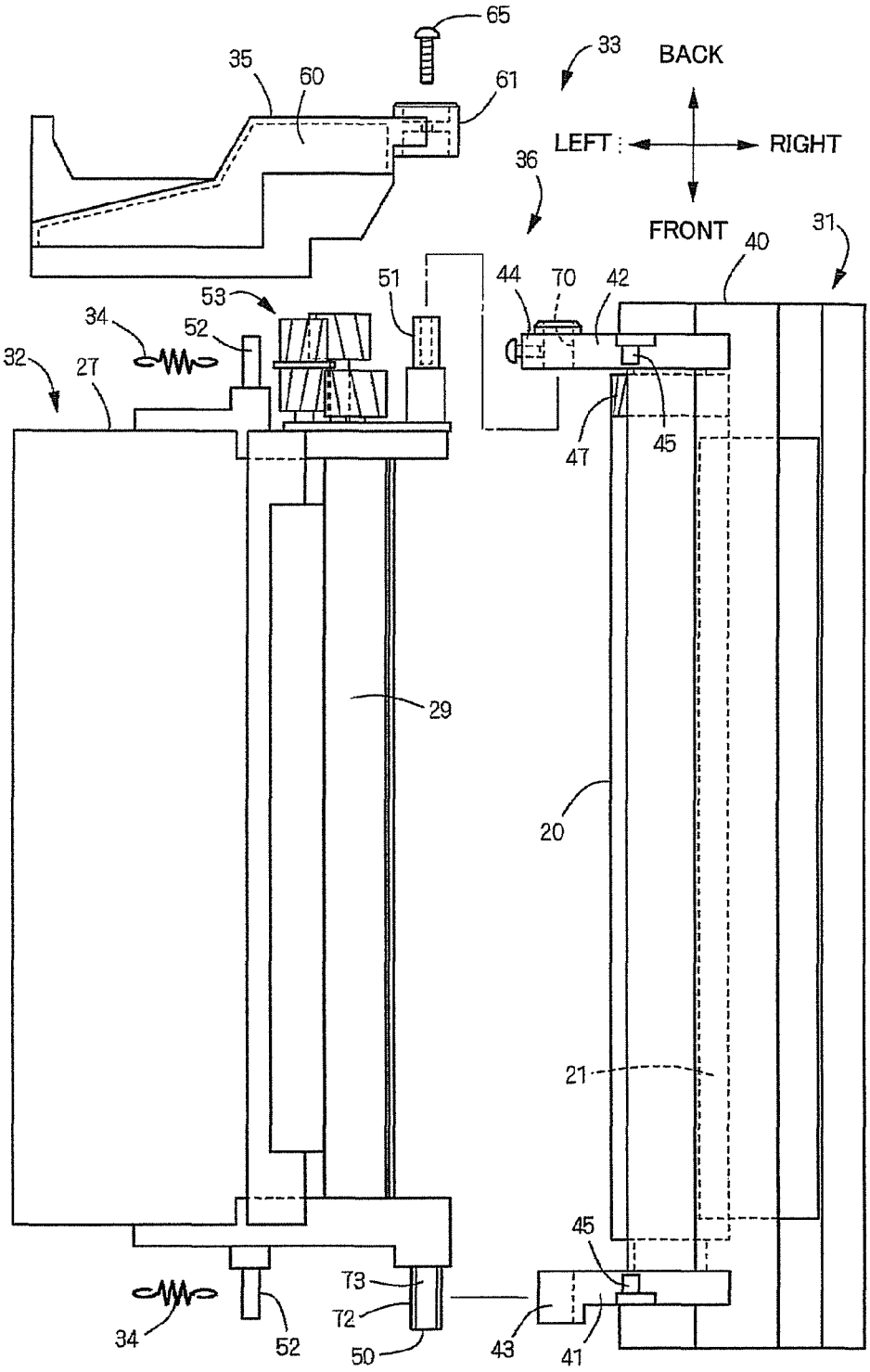
FIG. 5 is a schematic plain view of the photoconductive unit and the developing unit.

As illustrated in FIGS. 1 and 5, the coupling unit 33 includes the photoconductive unit 31, the developing unit 32, springs (elastic members) 34 arranged to providing a biasing force which presses the developing roller 29 against the photoconductive drum 20, and a cover member 35 mounted onto the coupling portion of both of the units 31 and 32. Between the photoconductive unit 31 and the developing unit 32, a coupling structure 36 arranged to couple the developing unit 32 with the photoconductive unit 31 is arranged. The springs 34 are helical extension coil springs. One end of the spring 34 is hung on a spring catcher 45 provided on the photoconductive unit 31, the other end is hung on a spring catcher 52 provided on the developing unit 32.

As illustrated in FIGS. 1 and 5, the photoconductive unit 31 includes as a main component a case 40 arranged to house the photoconductive drum 20, the charger 21 and the like. As illustrated in FIG. 1, a pair of front and back supporting arms 41 and 42 is arranged on the lower portion of the case 40. The supporting arms 41 and 42 extend downward and form at proximal ends thereof bearing portions (bearing members) 43 and 44 arranged to receive the coupling axis 50 and 51 located at the side of the developing unit 32 as described below. In addition, the case 40 arranges, respectively, the spring catchers 45 and 46 arranged to hook one end of the springs 34 at front and back ends of the lower portion thereof.

Figure 6:
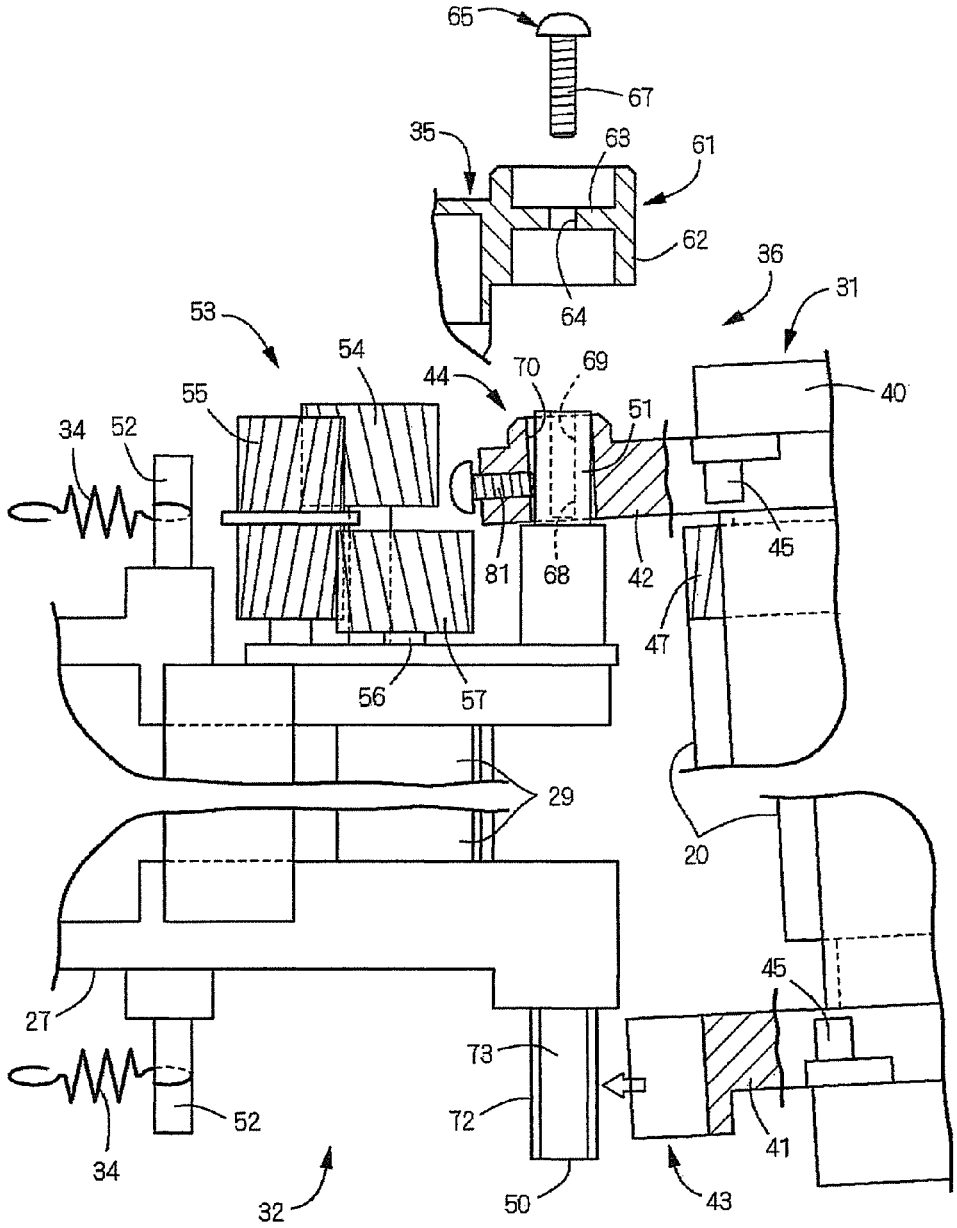
FIG. 6 is a schematic plain view for illustrating the adjusting mechanism.
Figure 7:
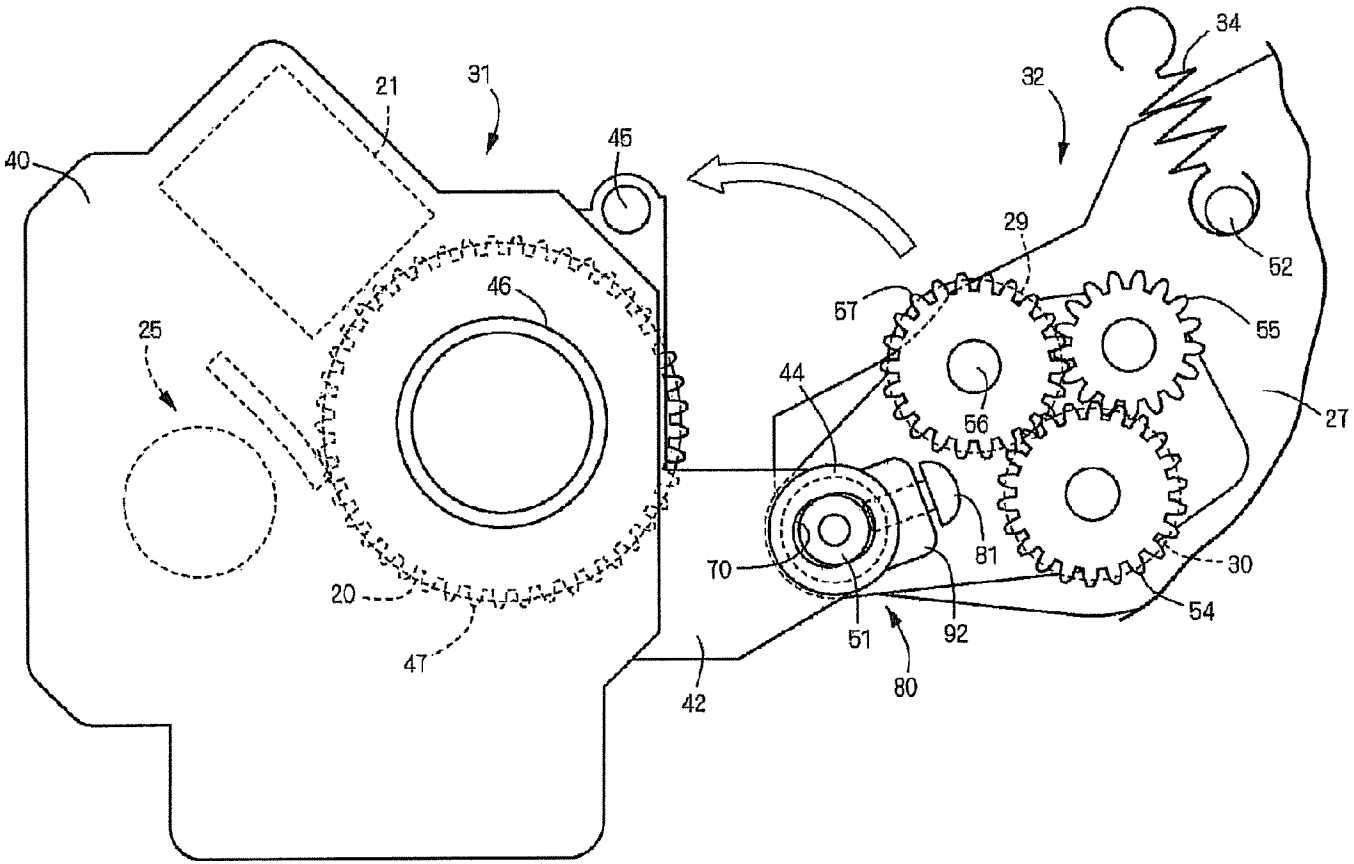
FIG. 7 is a view for illustrating an operation of mounting a developing unit onto a photoconductive unit.

The developing unit 32 includes as a main component the housing 27 arranged to house the developing roller 29 and the like. As illustrated in FIG. 1, a pair of front and back coupling axes 50 and 51 is arranged on the upper portion of the housing 27. The coupling axes 50 and 51 are arranged such that the axial directions of the axes 50 and 51 are the front and back directions. The housing 27 arranges, respectively, spring catchers 52 arranged to hook one ends of the springs 34 at front and back ends on the upper portion thereof. The housing 27 arranges, at the back side surface thereof, transmitting gear group 53 arranged to transmit driving force from a motor to the developing roller 29 and the photoconductive drum 20. As illustrated in FIGS. 6 and 7, the transmitting gear group 53 includes a first transmitting gear 54 arranged to receive driving force from the motor, a counter gear 55 arranged to gear with the first transmitting gear 54, and a roller gear 57 arranged to be mounted on an roller shaft 56 of the developing roller 29 to gear with the counter gear 55. On a drum shaft 46 of the photoconductive drum 20, a drum gear 47 arranged to gear with the roller gear 57 is mounted. Driving force received by the first transmitting gear 54 is transmitted to the roller gear 57 via the counter gear 55 and then transmitted to the drum gear 47 via the roller gear 57. As described above, the developing roller 29 and the photoconductive drum 20 are rotated to drive by receiving driving force from the motor. The transmitting gear group 53 and the drum gear 47 are helical gears.

As illustrated in FIG. 5, the cover member 35 includes a cover body 60 arranged to cover the transmitting gear group 53 and the like, and a fixing member 61 provided at the right end of the cover body 60 to fix the cover member 35 to the developing unit 32. As illustrated in FIG. 6, the fixing member 61 includes a cylindrical fixing piece 62 to be mounted on the back-side coupling axis 51, and a partition wall 63 formed inside of the fixing piece 62. On the center of a board surface on the partition wall 63, an elongated-hole-shaped through-hole 64 arranged to allow a screw (coupling member) 65 for fixing the cover member 35 to be inserted thereinto, is formed. A concave portion 69 with a female screw portion 68 is formed in the coupling axis 51. With the coupling axis 51 being inserted into the bearing portion 44, by screwing a male screw portion 67 of the screw 65 into the female screw portion 68 of the coupling axis 51 through the through-hole 64, the cover member 35 can be fixed to the coupling axis 51. In such a manner, by mounting the cover member 35 onto the coupling axis 51, the coupling axis 51 can be prevented from being moved in the axial direction in bearing portion 44. Accordingly, the developing roller 29 can be prevented from being accidentally moved in the axial direction (the front and back direction).

The coupling structure 36 arranged to couple the developing unit 32 with the photoconductive unit 31 includes the previously-mentioned coupling axes 50 and 51 provided on front and back portions of the upper end of the developing unit 32, and the bearing portions 43 and 44 provided on the proximal portions of the supporting arms 41 and 42 of the photoconductive unit 31. By fitting the coupling axes 50 and 51 into the bearing portions 43 and 44, the developing unit 32 is coupled with the photoconductive unit 31 in a relatively rotatable manner.

Figure 3:
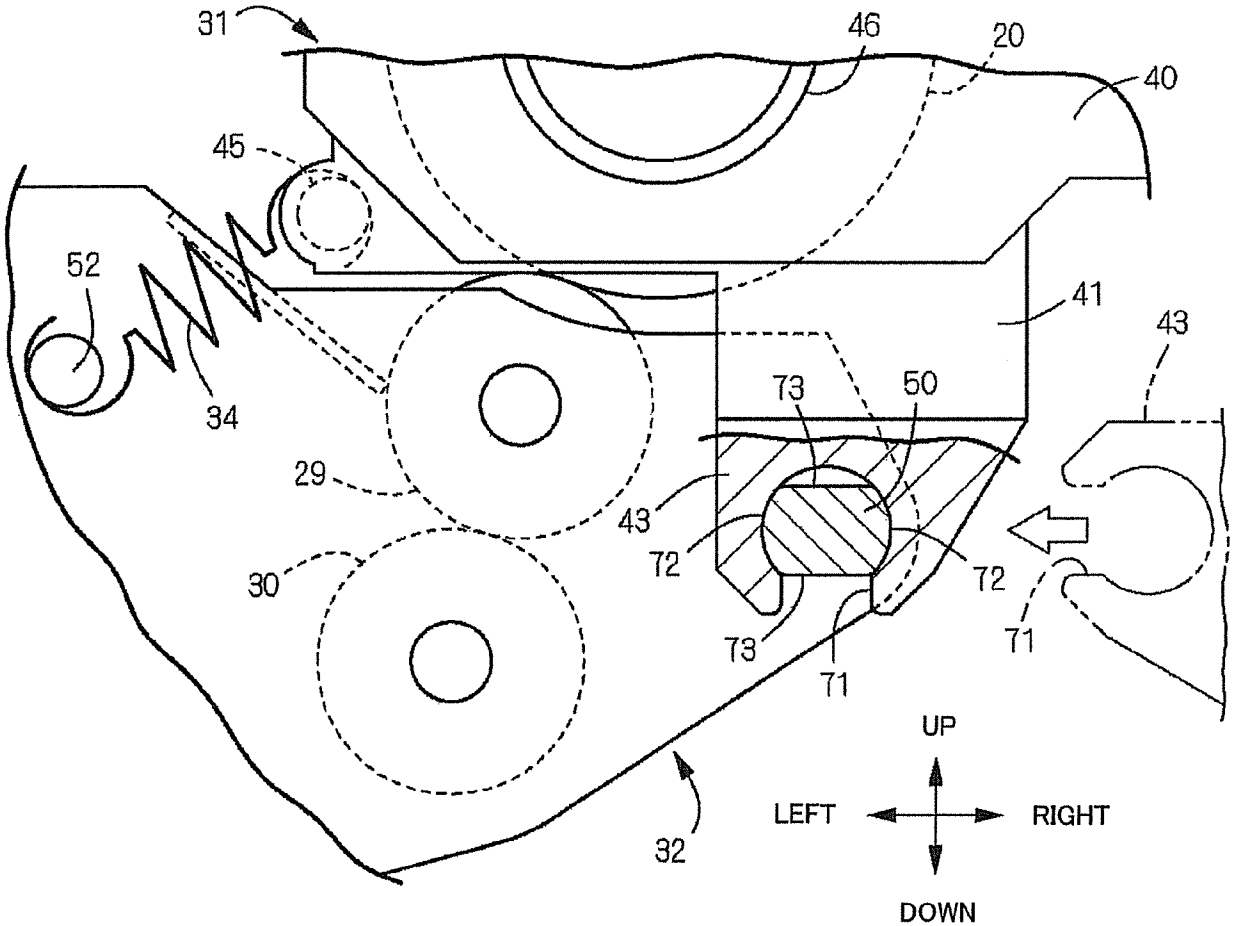
FIG. 3 is a view for illustrating an operation of mounting a developing unit onto a photoconductive unit.

To maintain a coupling condition certainly while making it easier to mount the developing unit 32 onto the photoconductive unit 31, the bearing portions 43 and 44 provided on the supporting arms 41 and 42 of the photoconductive unit 31 are configured as follows. As illustrated in FIGS. 1, 5 and 6, one (back side) bearing portion 44 is formed into a cylindrical shape (ring shape) by forming an elongated-hole-shaped bearing hole 70 which includes an opening portion in the front and back direction on the proximal end of the supporting arm 42. As illustrated in FIG. 3, the other (front side) bearing portion 43 is principally as formed into a cylindrical shape as the previously-mentioned bearing portion 44 is, and configured to form on a portion of peripheral wall a cutout portion 71 arranged to insert the coupling axis 50 thereinto. In addition, the one (back side) coupling axis 51 is formed into a cross-sectional cylindrical shape that includes the previously-mentioned recessed portion 69 (cf. FIG. 1). The other (front side) coupling axis 50 is formed into a cross-sectional quadrangular shape that includes partially-circular short sides 72 and liner long sides 73 (cf. FIG. 3). As illustrated FIG. 3, the width dimension of the coupling axis 50 in the short side direction is set to be slightly shorter than the opening dimension of the cutout portion 71 of the bearing portion 43. The length dimension of the coupling axis 50 in the long side direction is set to be slightly larger than the opening dimension of the cutout portion 71.

According to the coupling structure 36 as configured above, by coupling the developing unit 32 with the photoconductive unit 31 in accordance with the following steps, the coupling unit 33 can be obtained. Firstly, as illustrated in FIG. 5, the cylindrical shaped coupling axis 51 is inserted into the bearing hole 70 on the ring-shaped one (back side) bearing part 44. Next, as illustrated by virtual lines in FIG. 3, the developing unit 32 is positioned such that the cutout portion 71 of the bearing portion 43 faces the circular short side 72 of the one (front side) coupling axis 50, and then the coupling axis 50 is inserted into the bearing portion 43 through the cutout portion 71. This can couple the developing unit 32 with the photoconductive unit 31. Next, the developing unit 32 is rotated upon the respective coupling axes 50 and 51 inserted into the respective bearing portions 43 and 44 in the direction along which the developing roller 29 comes close to the photoconductive drum 20 (cf. FIG. 7). This can make the short side direction of the coupling axis 50 different from the opening direction of the cutout portion 71 of the bearing portion 43 (cf. FIG. 3), thereby preventing the coupling axis 50 from being accidently dropped out from the bearing portion 43 to disengage the coupling condition between the both units 31 and 32. Rotating the developing unit 32 in the direction along which the developing roller 29 comes close to the photoconductive drum 20 can also make the roller gear 57 and the drum gear 47 gear with each other. At this moment, the drum gear 47 is set to gear with the roller gear 57 while following a circular path, so that when teeth ends of the both gears 47 and 57 come into contact, both gears 47 and 57 can gear with each other while edge outing the teeth ends of the both gears 47 and 57, thereby preventing the teeth ends from being damaged. Then, the springs 34 are hooked between the spring catchers 45 and 52 of both units 31 and 32. Finally, the cover body 60 is arranged to cover the transmitting gear group 53, and then the male screw portion 67 of the screw 65 is screwed into the female screw portion 68 of the coupling axis 51, thereby fixing the cover member 35 to the sides of both units 31 and 32.

Figure 4:
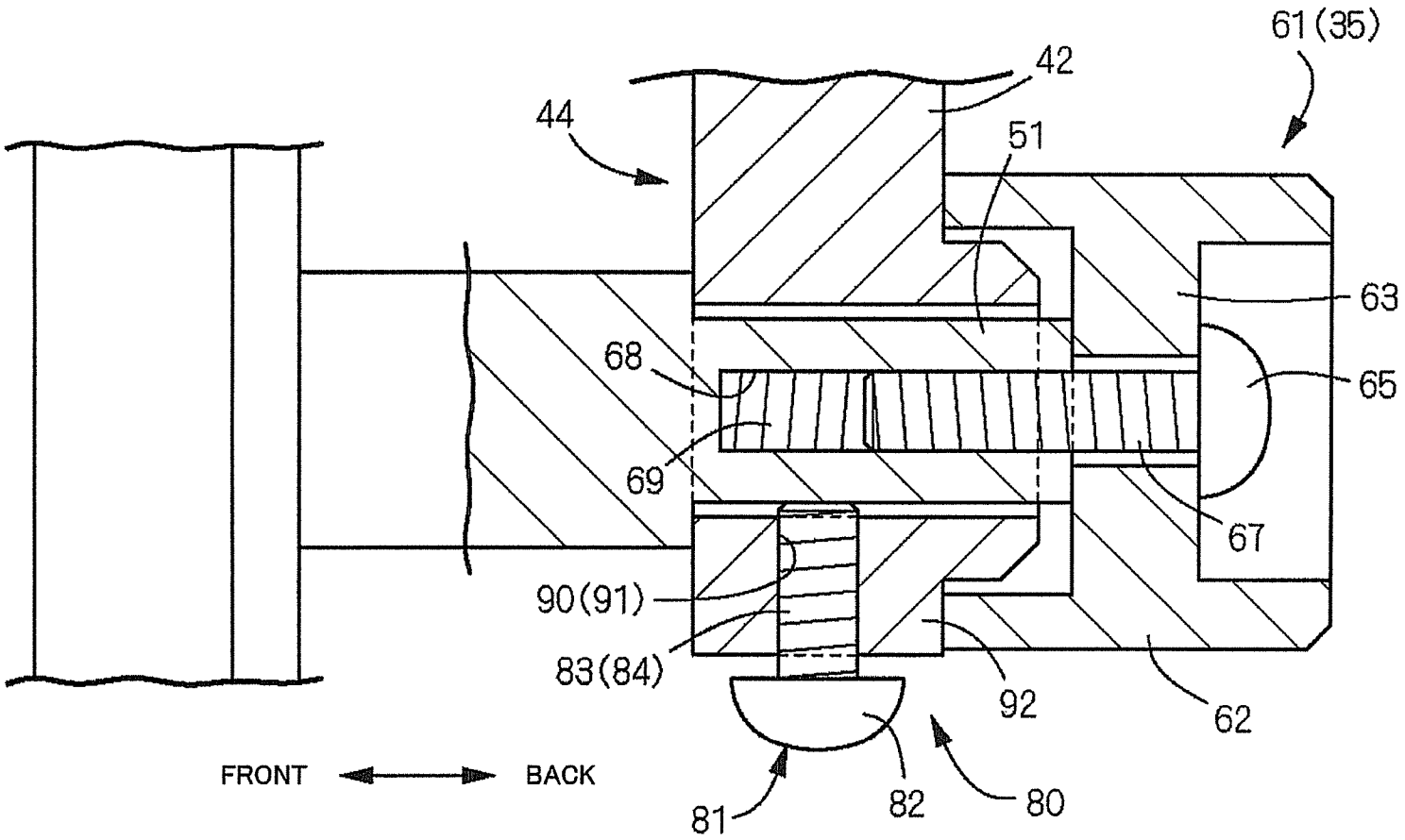
FIG. 4 is a view for illustrating an adjusting mechanism.

In addition, the multifunction peripheral 1 according to the present embodiment features an arrangement of an adjusting mechanism (pressing force adjusting mechanism, parallelism adjusting mechanism) 80 in the coupling structure 35, which structure is arranged to adjust pressing force, provided by the springs 34 and 34, of the developing roller 29 against the photoconductive drum 20 and to adjust the parallelism of the developing roller 29 against the photoconductive drum 20. As illustrated in FIGS. 1 and 4, the adjusting mechanism 80 includes the back side coupling axis 51, the back side bearing portion 44 with the elongated-hole-shaped bearing hole 70, and a positioning member arranged to position the coupling axis 51 in the bearing portion 44. The positioning member is a screw 81, the screw 81 functions not only as an element for positioning the coupling axis 51 but also as an element for operating the adjusting mechanism 80. The screw 81 includes a head portion 82 which is provided with a concave portion, a slot and the like for rotational operation, and an axis portion 84 provided with a male screw portion 83, and is set to be screwed into a screw hole 91, which is formed in the bearing portion 44 to have a female screw portion 90, in a condition that the head portion 82 is positioned to face outward. The screw hole 91 is a through-hole which is formed from an outer surface of the bearing portion 44 to the bearing hole 70. The sign 92 indicates a protruding portion which is formed by swelling out the outer surface of the bearing portion 44 to extend the length dimension of the screw hole 91.

Figure 8:
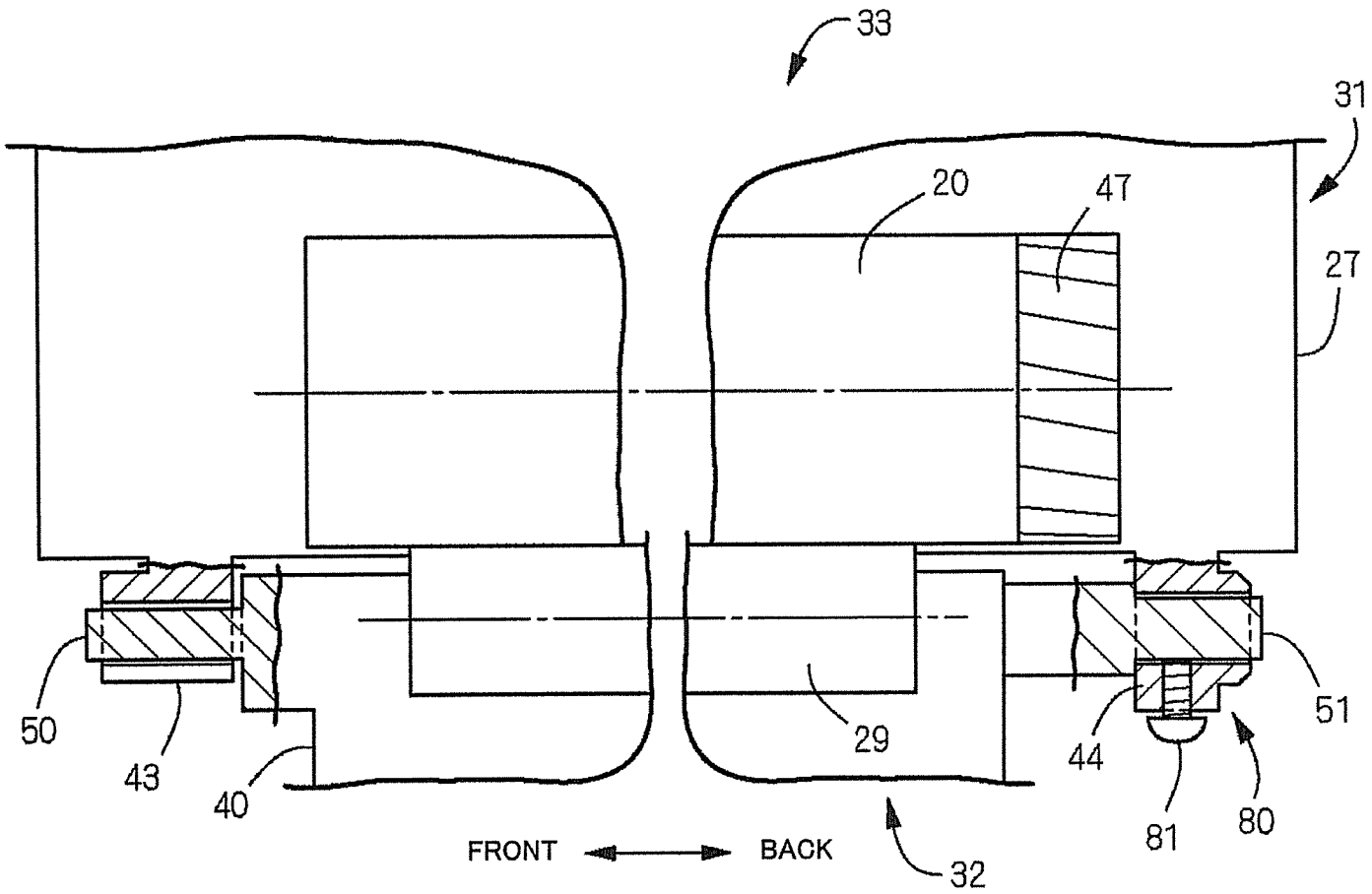
FIG. 8 is a view for illustrating an adjusting mechanism.

The adjusting mechanism 80 as configured above is configured to make the moving direction 100 of the coupling axis 51 in the bearing hole 70 parallel to the extending direction of a straight line 101 which connects both of the rotation centers of the photoconductive drum 20 and the developing roller 29 (hereinafter defined as reference straight line) (cf. FIG. 1). More specifically, the extending direction of the elongated-hole-shaped bearing hole 70 and the extending direction of the screw hole 91 are made parallel to the extending direction of the reference straight line 101. The above configuration allows the moving direction of the coupling axis 51, which is operated to move by an axis end of the axis portion 84 while the screw 81 is operated to rotate, to be parallel to the extending direction of the reference straight line 101. Accordingly, operating to rotate the head portion 82 of the screw 81 with such operational tool as a screwdriver can move the coupling axis 51 in the bearing hole 70, thereby enabling the developing roller 29 to be positionally adjusted parallel to the photoconductive drum 20. In other words, as illustrated in FIG. 8, this can make the axial direction of the developing roller 29 identical with the axial direction of the photoconductive drum 20. In addition, moving the coupling axis 51 in the bearing hole 70 can make adjustably pressing force of the developing roller 29, which force derives from biasing force of the springs 34, large or small against the photoconductive drum 20.

As described above, the multifunction peripheral 1 is configured to arrange in the coupling structure 36 the adjusting mechanism 80 arranged to adjust pressing force, provided by the springs 34, of the developing roller 29 against the photoconductive drum 20, thereby modifying and adjusting the pressing force of the developing roller 29 which is pressed to the photoconductive drum 20 by biasing force from the springs 34. That is, even in a case where the developing rollers 29 have various radius dimensions or where the springs 34 develop variations in elastic force thereof, adequate pressing force depending on each case can be applied to the developing roller 29. Further, adjusting the position of the developing roller 29 against the photoconductive drum 20 can make the developing roller 29 take right parallel position against the photoconductive drum 20. As described above, the recorded image quality of the multifunction peripheral 1 provided with the adjusting mechanism 80 can be expected to improve in quality.

Only operating the screw 81 to modify the position of the coupling axis 51 against the bearing member 44 can modify and adjust pressing force of the developing roller 29 against the photoconductive drum 20, thereby simplifying the structure to suppress increase of manufacturing costs for the multifunction peripheral 1 provided with the adjustment mechanism 80. When the developing unit 32 is replaced, after a new developing unit 32 is coupled with the photoconductive unit 31, the pressing force can be adjusted by using the adjustment mechanism 80, thereby providing an excellent easy adjustment operation. Further, rotational operation of the head portion 82 of the screw 81 can arbitrarily (in a continuously variable manner) modify and adjust pressing force of the developing roller 29 against the photoconductive drum 20. Consequently, the adjustment operation of the pressing force can be conducted adequately and easily.

Figure 9:
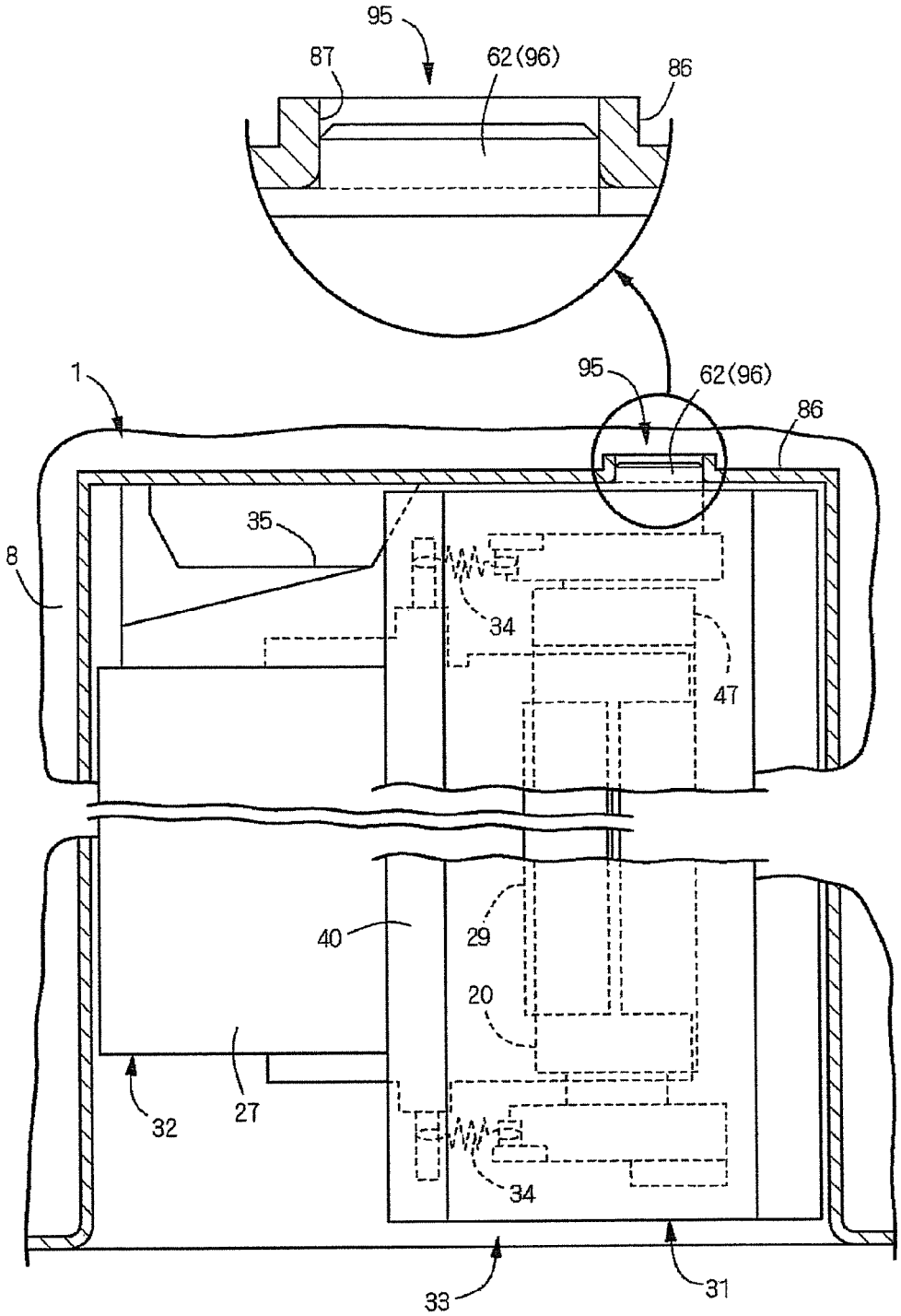
FIG. 9 is a schematic plain view for illustrating a regulating structure.

The multifunction peripheral 1 arranges, between the frame 86 of the apparatus body 8 and the coupling unit 33, the regulating structure 95 arranged to regulate movement of the coupling unit 33 in the apparatus body 8 in the axial direction of the photoconductive drum 20. As illustrated in FIG. 9, the regulating structure 95 is configured to include the protruding portion 96 formed on the cover member 35, and the concave portion 87 formed on the frame 86 of the apparatus body 8 to receive the protruding portion 96. As found in the present embodiment, the fixing piece 62 of the previously-mentioned cover member 35 is extended to the side of the frame 86 beyond the cover body 60, thereby making the extended portion function as the protruding portion 96. This can prevent the photoconductive unit 31 and the developing unit 32 from being accidently dislocated even in a case where the coupling unit 33 including the photoconductive unit 31 happens to receive a shock. The protruding portion 96 formed on the cover member and the concave portion 87 formed on the frame 86 of the apparatus body 8 are configured to define the regulating structure 95, thereby simplifying the regulating structure 95 to suppress increase of manufacturing costs for the multifunctional peripheral 1.

While the present invention has been described with respect to embodiments thereof, it will be apparent to those skilled in the art that the disclosed invention may be modified in numerous ways and may assume many embodiments other than those specifically set out and described above. Accordingly, the appended claims cover all modifications that fall within the true spirit and scope of the present invention.

What is claimed is:

1. An image recording device comprising:

a photoconductive unit arranged to include a photoconductive drum, a developing unit arranged to include a developing roller, and a coupling structure that is arranged between the photoconductive unit and the developing unit to removably and rotatably couple the developing unit with the photoconductive unit, wherein an elastic member arranged to apply a pressing biasing force toward the photoconductive drum to the developing roller is arranged between the photoconductive unit and the developing unit, the coupling structure is arranged to include a pressing force adjusting mechanism arranged to adjust a pressing force of the developing roller against the photoconductive drum, which force is provided by the elastic member, the pressing force adjusting mechanism is configured to include a coupling axis arranged on the developing unit, a bearing member arranged on the photoconductive unit to hold the coupling axis in a freely movable manner, and a positioning member arranged to position the coupling axis in the bearing member, the positioning member is a screw, and the bearing member is configured to include a female screw portion into which the screw is screwed.

2. The image recording device according to claim 1, wherein the coupling axis is configured to be rotatable in the bearing member while contacting with an axis end of an axis portion of the screw.

3. An image recording device comprising:

a photoconductive unit arranged to include a photoconductive drum, a developing unit arranged to include a developing roller, and a coupling structure that is arranged between the photoconductive unit and the developing unit to removably and rotatably couple the developing unit with the photoconductive unit, wherein an elastic member arranged to apply a pressing biasing force toward the photoconductive drum to the developing roller is arranged between the photoconductive unit and the developing unit, the coupling structure is arranged to include a pressing force adjusting mechanism arranged to adjust a pressing force of the developing roller against the photoconductive drum, which force is provided by the elastic member, the pressing force adjusting mechanism is configured to include a coupling axis arranged on the developing unit, a bearing member arranged on the photoconductive unit to hold the coupling axis in a freely movable manner, and a positioning member arranged to position the coupling axis in the bearing member, a cover member is mounted on an outer surface of the photoconductive unit, and the cover member and the coupling axis are coupled by a coupling member to regulate movement of the coupling axis in the axial direction in the bearing member.

4. An image recording device comprising:

a photoconductive unit arranged to include a photoconductive drum, a developing unit arranged to include a developing roller, and a coupling structure that is arranged between the photoconductive unit and the developing unit to removably and rotatably couple the developing unit with the photoconductive unit, wherein an elastic member arranged to apply a pressing biasing force toward the photoconductive drum to the developing roller is arranged between the photoconductive unit and the developing unit, the coupling structure is arranged to include a pressing force adjusting mechanism arranged to adjust a pressing force of the developing roller against the photoconductive drum, which force is provided by the elastic member, a regulating structure is arranged on the photoconductive unit to regulate, in cooperation with a frame of an apparatus body of an image forming apparatus, movement of the photoconductive unit in the axial direction of the photoconductive drum in the apparatus body, a cover member arranged to regulate movement of the developing roller in the axial direction is mounted on the photoconductive unit, and the regulating structure is configured to include a protruding portion formed on the cover member, and a concave portion formed on the frame of the apparatus body to receive the protruding portion.

5. An image recording device comprising:

a photoconductive unit arranged to include a photoconductive drum, a developing unit arranged to include a developing roller, and a coupling structure that is arranged between the photoconductive unit and the developing unit to hold removably and rotatably the developing unit against the photoconductive unit, wherein an elastic member arranged to apply a pressing biasing force toward the photoconductive drum to the developing roller is arranged between the photoconductive unit and the developing unit, the coupling structure is provided with a parallelism adjusting mechanism arranged to adjust parallelism of the developing roller against the photoconductive drum, the parallelism adjusting mechanism is configured to include a coupling axis arranged on the developing unit, a bearing member arranged on the photoconductive unit to hold the coupling axis in a freely movable manner, and a positioning member arranged to position the coupling axis in the bearing member, the bearing member includes an elongated-hole-shaped bearing hole and the coupling axis is configured to be freely movable in the bearing hole, and the extending direction of the bearing hole and the extending direction of the positioning member are configured to be identical with the direction of a straight line that connects the rotating shaft of the photoconductive drum and the rotating shaft of the developing roller.

* * * * *